US008084949B2

(12) United States Patent
Nerone

(10) Patent No.: US 8,084,949 B2
(45) Date of Patent: Dec. 27, 2011

(54) FLUORESCENT BALLAST WITH INHERENT END-OF-LIFE PROTECTION

(75) Inventor: Louis R. Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 413 days.

(21) Appl. No.: 12/500,009

(22) Filed: Jul. 9, 2009

(65) Prior Publication Data

US 2011/0006699 A1 Jan. 13, 2011

(51) Int. Cl.
*H05B 41/36* (2006.01)

(52) U.S. Cl. ..... 315/158; 315/224; 315/247; 315/272; 315/291; 315/307

(58) Field of Classification Search ..... 315/158, 315/224, 247, 268, 272, 291, 307
See application file for complete search history.

(56) References Cited

U.S. PATENT DOCUMENTS

| | | | | |
|---|---|---|---|---|
| 4,277,726 | A * | 7/1981 | Burke | 315/98 |
| 5,063,331 | A * | 11/1991 | Nostwick | 315/219 |
| 5,162,700 | A | 11/1992 | Soileau | |
| 5,796,214 | A | 8/1998 | Nerone | |
| 5,877,595 | A * | 3/1999 | Nerone | 315/209 R |
| 6,078,143 | A | 6/2000 | Nerone et al. | |
| 6,417,631 | B1 | 7/2002 | Chen et al. | |
| 6,429,604 | B1 | 8/2002 | Chang | |
| 6,509,696 | B2 | 1/2003 | Bruning et al. | |
| 6,815,908 | B2 | 11/2004 | Glaser et al. | |
| 6,836,077 | B2 | 12/2004 | Nerone | |
| 6,867,553 | B2 | 3/2005 | Nerone et al. | |
| 7,183,714 | B1 | 2/2007 | Choudhury | |
| 7,436,124 | B2 | 10/2008 | Nerone et al. | |
| 2005/0184685 | A1 | 8/2005 | Sekine et al. | |

FOREIGN PATENT DOCUMENTS

| | | | |
|---|---|---|---|
| EP | 0901315 | A1 | 3/1999 |
| EP | 0926928 | A1 | 6/1999 |
| EP | 1657968 | A2 | 5/2006 |
| EP | 1991033 | A2 | 11/2008 |

OTHER PUBLICATIONS

International Search Report issued in connection with corresponding International Application No. PCT/US2010/037396on Aug. 31, 2010.

* cited by examiner

*Primary Examiner* — Jason M Crawford
(74) *Attorney, Agent, or Firm* — Fay Sharpe LLP

(57) ABSTRACT

A ballast with end-of-life ("EOL") protection is presented in which the voltage across a lamp at EOL is controlled to prevent the lamp from overheating, while the voltage across the lamps not at EOL is maintained to allow normal operation of those lamps, and when a new lamp is added to the ballast, the AC voltage across all lamps is controlled to allow ignition of the newly added lamp without cycling the power of the ballast.

10 Claims, 5 Drawing Sheets

FLUORESCENT BALLAST WITH INHERENT END-OF-LIFE PROTECTION

BACKGROUND OF THE DISCLOSURE

The filaments of fluorescent lamps are covered with emission mix to facilitate passage of electrons through the gas for production of light. Over time, the emission mix is sputtered off of the filaments in normal operation, but a larger amount is sputtered off when the lamp is ignited with cold cathodes. When the emission mix becomes depleted, the lamp nears end-of-life ("EOL"). When the filament emission mix becomes depleted, a higher voltage is required for the cathodes to emit electrons. The other filament in the lamp may not have an equally depleted emission mix, therefore, electrons from the good cathode will bombard the depleted filament with electrons, but the depleted filament will require a higher voltage to force the electrons back to the good filament. This higher voltage results in an increase in temperature which may overheat the lamp and in some cases crack the glass if the lamp is not replaced.

Program-start ballast systems provide a longer life to fluorescent lamps by pre-heating the lamp filaments on startup before igniting the lamps, thereby mitigating emission mix depletion. Other conventional solutions to this problem involve detecting when a lamp is rectifying, which indicates a depletion of emission mix on a cathode, and turning off the ballast inverter to remove power from the lamps and thus prevent the lamp from overheating. This approach, however, also extinguishes all the non-rectifying lamps in parallel ballast configurations, which is undesirable since a user does not know which lamp has reached the EOL state. One solution increases the number of inverters in the ballast, for instance, where half of the lamps are powered from one inverter and the other half are powered from another inverter. This approach extinguishes half of the lamps connected to the ballast when a lamp is in rectification, leaving the other inverter powered to provide lighting while the EOL lamp is identified and replaced, but adds cost and complexity for every inverter added. Thus, there is a continuing need for cost-effective ballast with improved end-of-life protection.

SUMMARY OF THE DISCLOSURE

The present disclosure provides a simple low-cost ballast apparatus with improved end-of-life ("EOL") protection and control techniques that may be employed to prevent a lamp near EOL from overheating, without extinguishing the non-rectifying lamps in the ballast, and without requiring multiple inverters. The disclosed ballasting techniques may be advantageously employed in parallel-connected systems or other multiple-lamp configurations to facilitate identification of EOL lamps while continuing to provide power to non-rectifying (non-EOL) lamps to aid the user in visually identifying which lamp or lamps need to be replaced.

A ballast with EOL protection is disclosed, which includes a DC power circuit driving an inverter which produces a voltage to power one or more fluorescent lamps via corresponding ballasting capacitors, with a voltage regulator to control the inverter output at a High Frequency Bus (HFB) to allow non-rectifying lamps to operate at their rated current and rectification of a lamp causes the corresponding ballasting capacitor to charge up to a point where the capacitor cannot maintain sufficient current to keep the rectifying lamp lit and the rectifying lamp goes into a glow state. The inverter regulation thus limits the inverter output so that conduction of a rectifying lamp cannot be maintained by the ballasting capacitor while conduction of non-rectifying lamps is maintained thus the non-rectifying lamps continue to produce light while the rectifying lamp is in the glow state. In this condition, the glowing EOL lamp is easily distinguishable from the non-rectifying lamps, and a user can perform relamping in a lighted environment without having to cycle power.

The regulator in certain embodiments operates in an igniting state to control the inverter output voltage such that the voltage across the non-rectifying lamps is at or above a lamp igniting voltage, and the ballast may include a warm-start circuit which detects whether a lamp has been added, switches the regulator into the igniting state, and to returns the regulator to the normal operation state after a predetermined period of time so that the newly added lamp is ignited without requiring a user to cycle power to the ballast. This warm-start circuit allows a lamp to be added to the ballast while the ballast is running to ignite without cycling power on the ballast. When a user installs a lamp in the ballast circuit, the ballast detects the relamping and the warm-start circuit controls the voltage regulator to enter the igniting state and causes the voltage across the lamps to rise to a level required to ignite the newly added lamp. After a predetermined period of time has passed, the warm-start circuit returns the regulator to the normal operating state, allowing the lamps to return to their normal operating currents. Certain embodiments may also include a program-start circuit to pre-heat lamp cathodes and then apply the inverter output voltage to ignite the lamps.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
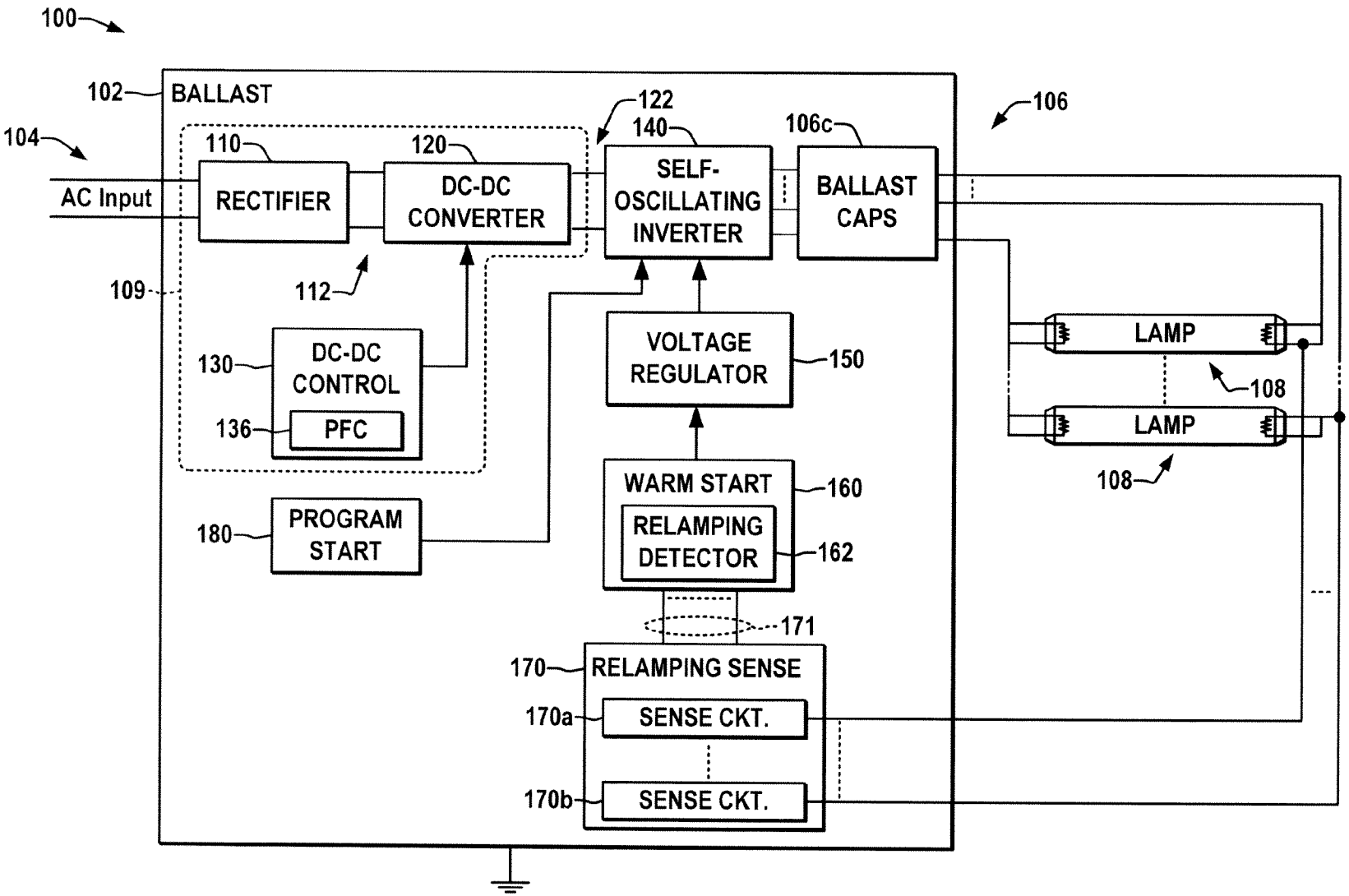
FIG. 1 is a schematic diagram illustrating an exemplary ballast with end-of-life ("EOL") protection having a self-oscillating inverter with a regulator providing advanced cathode heat and voltage regulation for translating rectifying lamps to a glow state while maintaining adequate current supply to non-rectifying lamps, as well as a warm-start circuit for replacement lamp ignition on re-lamping.

Referring now to the drawings, where like reference numerals are used to refer to like elements throughout, and wherein the various features are not necessarily drawn to scale, the present disclosure relates to electronic lighting and more particularly to ballasts with end-of-life ("EOL") protection for use in connection with parallel-connected fluorescent lamps and will be described with particular reference thereto, although the exemplary ballasts described herein can also be used in other lighting applications and configurations, and are not limited to the aforementioned application. For example, various disclosed advances can be employed in single-lamp ballasts, series-coupled multiple-lamp ballasts, and the like.

FIG. 1 illustrates an exemplary program-start, non-dimming ballast with EOL protection 102 in which the current supplied to a rectifying lamp 108*r* is reduced through ballast capacitor charging to force the rectifying lamp into a glow state, while the non-rectifying lamps 108*n* continue to operate at normal operating levels. The glow state of a lamp 108 is entered when the corresponding ballast capacitor 106*c* charges to a point where insufficient current is supplied to the lamp 108 to maintain normal operation. The ballast 102 includes a DC power circuit 109 with a rectifier 110 receiving input power from an AC input 104, where the rectifier can be active or passive, or the ballast 102 can alternatively be supplied with DC input power with the circuit 109 omitted. The rectifier 110 in the illustrated embodiment has an output 112 providing a rectified DC voltage to a switching type DC-DC converter 120, which includes various switching devices operated by suitable control signals (not shown) to generate a DC output 122. In one embodiment, further illustrated and described in connection with FIG. 2 below, the converter 120 is a boost converter with a controller 130 that may include a power factor control ("PFC") component 136 to control the power factor of the ballast 102.

The ballast 102 further includes an inverter 140 which receives the DC voltage 122 and provides an AC output 106 to drive one or more parallel lamp loads 108 through corresponding ballast capacitances 106*c*. The inverter 140 operates under control of a voltage regulator 150 and a program-start circuit 180. The exemplary inverter 140 is self-oscillating as further illustrated in FIG. 3 below, although not a requirement of the present disclosure and other forms of power conversion circuitry can be used by which a high frequency bus (HFB) is generated for driving one or more lamps 108. In operation, rectification in one or more lamps 108*r* at or approaching end of life conditions charges the corresponding ballast capacitance 106*c* which then cannot maintain the normal operating current and the rectifying lamp goes to a glow state. This prevents the rectifying lamp 108*r* from overheating while the non-rectifying lamps 108*n* (FIG. 5) continue normal operation, as further illustrated and described in connection with FIG. 3 below.

Figure 4:
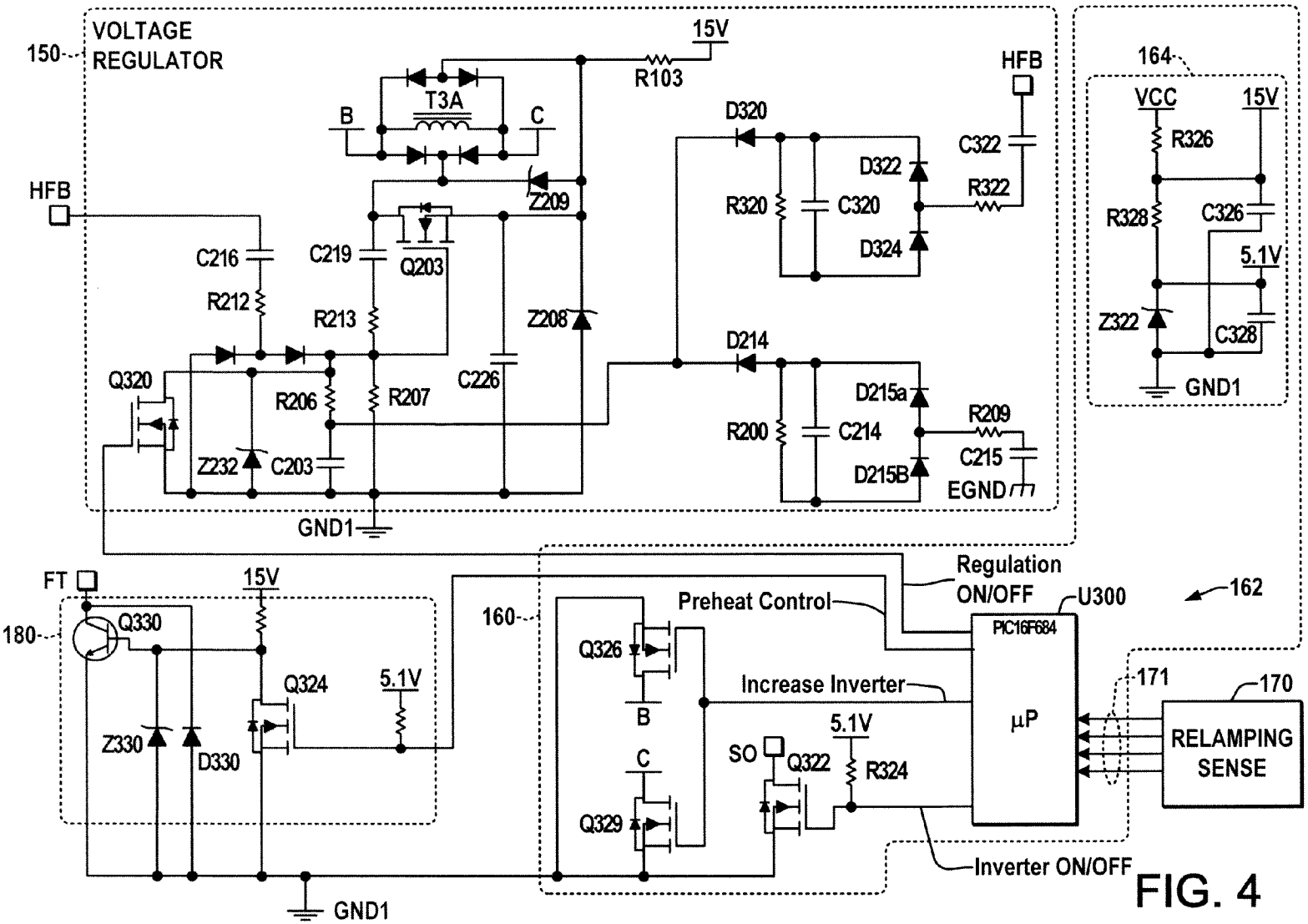
FIG. 4 is a detailed schematic diagram illustrating an exemplary warm-start circuit and voltage regulator circuit in the ballast of FIGS. 1-3.
Figure 5:
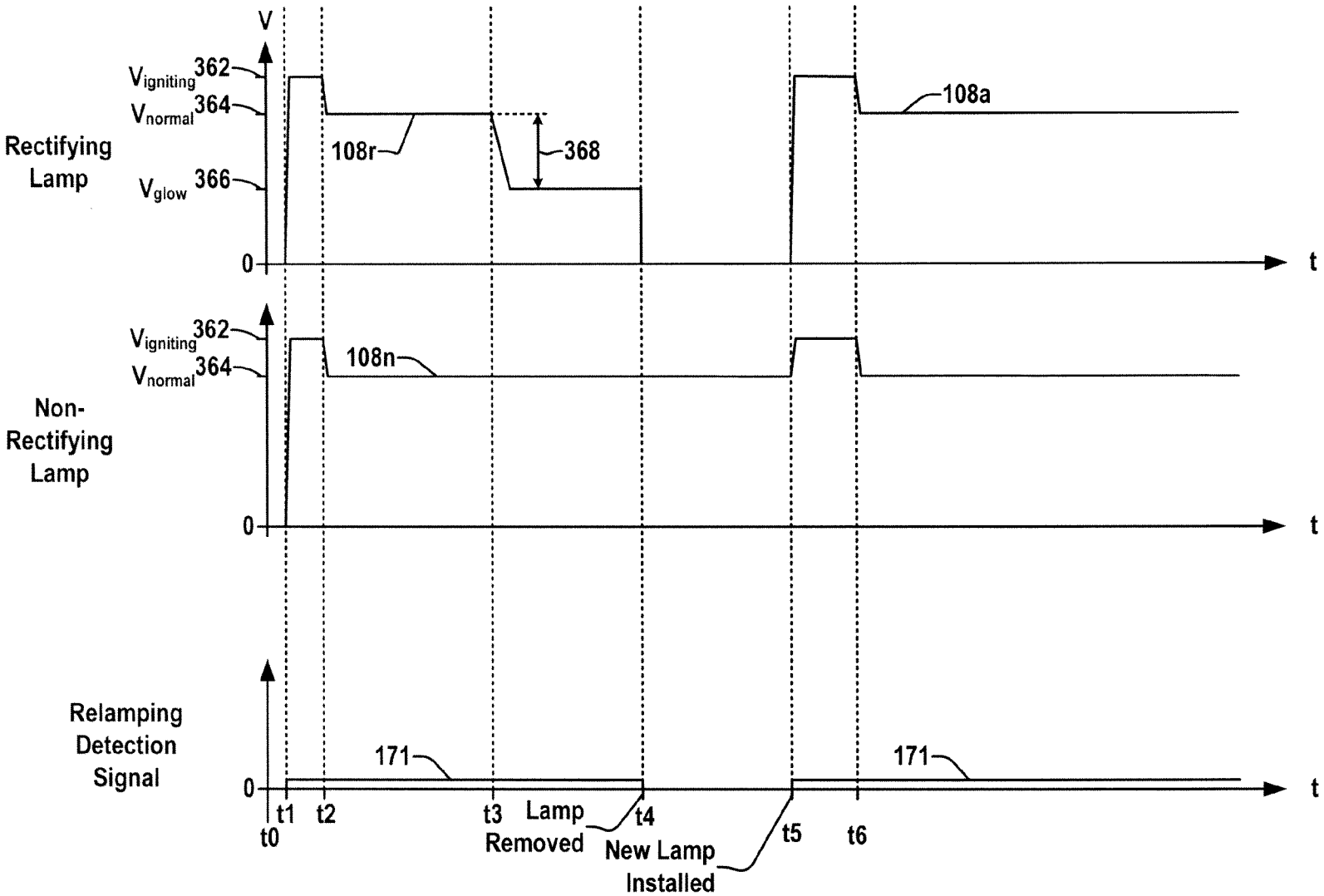
FIG. 5 is a graph illustrating rectifying and non-rectifying lamp voltage waveforms and relamping detection signals in the ballast of FIGS. 1-4.

In some embodiments, the exemplary ballast 102 includes a warm-start circuit 160 with a relamping detector circuit 162 which detects when a lamp 108*a* (FIG. 5) has been added to the ballast 102 while the ballast 102 is powered. The warm-start circuit 160 controls the voltage regulator 150 such that a lamp igniting voltage is provided to the lamps 108 when installation of a new lamp 108*a* is detected by the circuit 162, where the exemplary warm-start circuit 160 is illustrated in greater detail in FIG. 4 below and FIG. 5 illustrates exemplary voltage levels of the lamps 108 and a relamping sense circuit 170 throughout various operational conditions.

Figure 2:
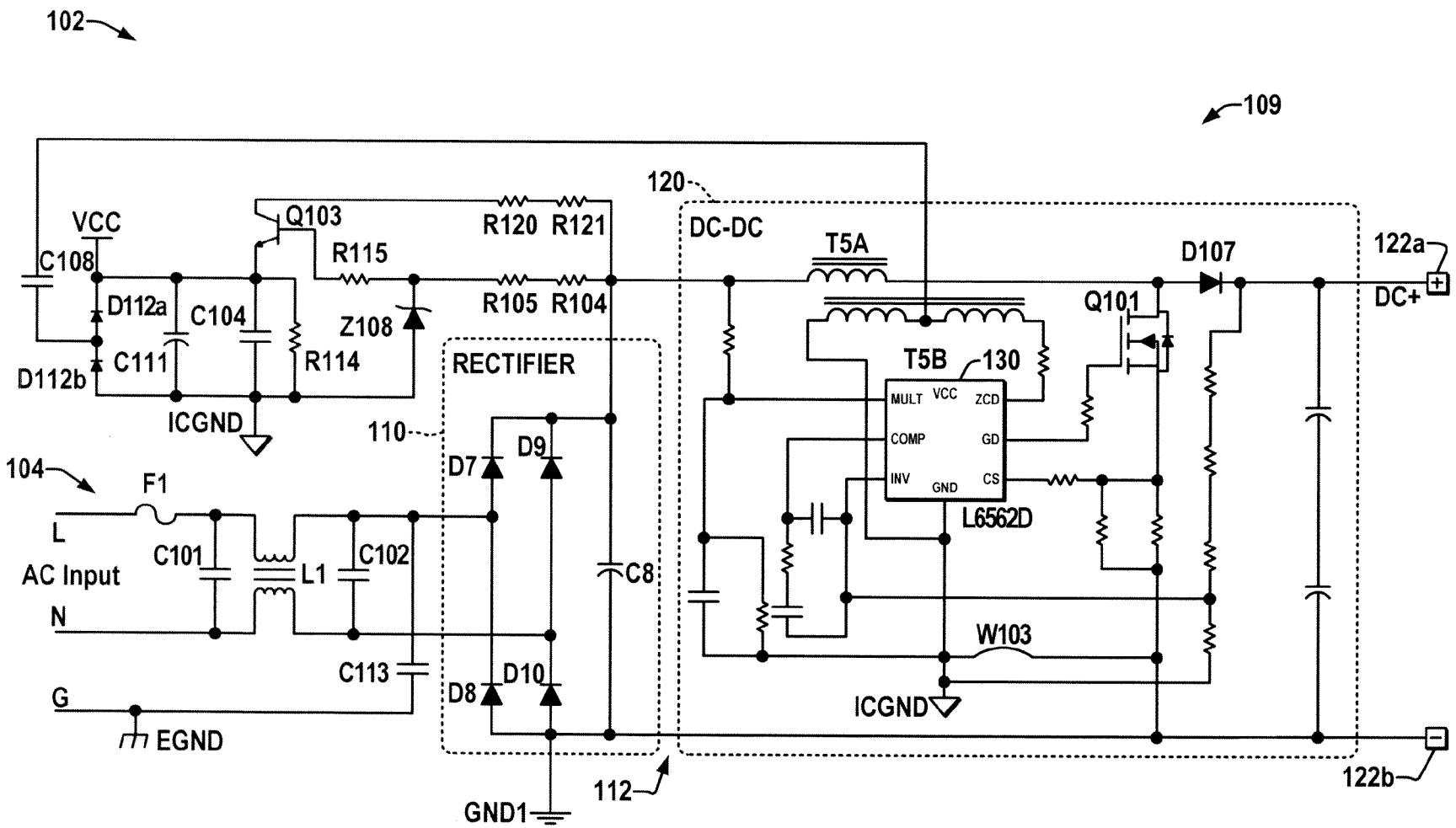
FIG. 2 is a detailed schematic diagram illustrating an exemplary DC power circuit with a rectifier and boost DC-DC converter in the ballast of FIG. 1.

FIG. 2 illustrates one suitable embodiment of a DC power circuit 109 including a rectifier 110 and boost DC-DC converter 120 that may be used in the exemplary ballast 102. The rectifier 10 receives input AC power 104 from line and neutral connections L and N of the input 104, respectively, and includes an earth ground connection G for connection to a ground EGND and a line-ground capacitor C113, and the input 104 may include various additional components, such as capacitors C101 and an inductor L1. The rectifier 110 provides a full wave diode bridge including diodes D7-D10 and an output filter capacitor C8 to provide an initial DC output 112 that is received as an input to the DC-DC converter 120. An integrated circuit DC voltage VCC is provided relative to a circuit ground ICGND in this embodiment via a shunt regulator circuit including a 15 volt zener diode Z108, a bipolar transistor Q103 and resistors R104, R105, R114, R115, R120, and R121, as well as output capacitors C104 and C111. The center of a transformer winding T5B is capacitively coupled via capacitor C108 to a center of the VCC supply using diodes D112*a* and D112*b*. The exemplary DC-DC converter 120 is a boost converter receiving the initial DC output and selectively switching a FET Q101 according to signals from a controller 130 to provide a second DC output at terminals 122*a* and 122*b* for driving the inverter 140. The converter 120 includes a boost converter inductance T5A having secondary control winding T5B connected to the controller 130.

Figure 3:
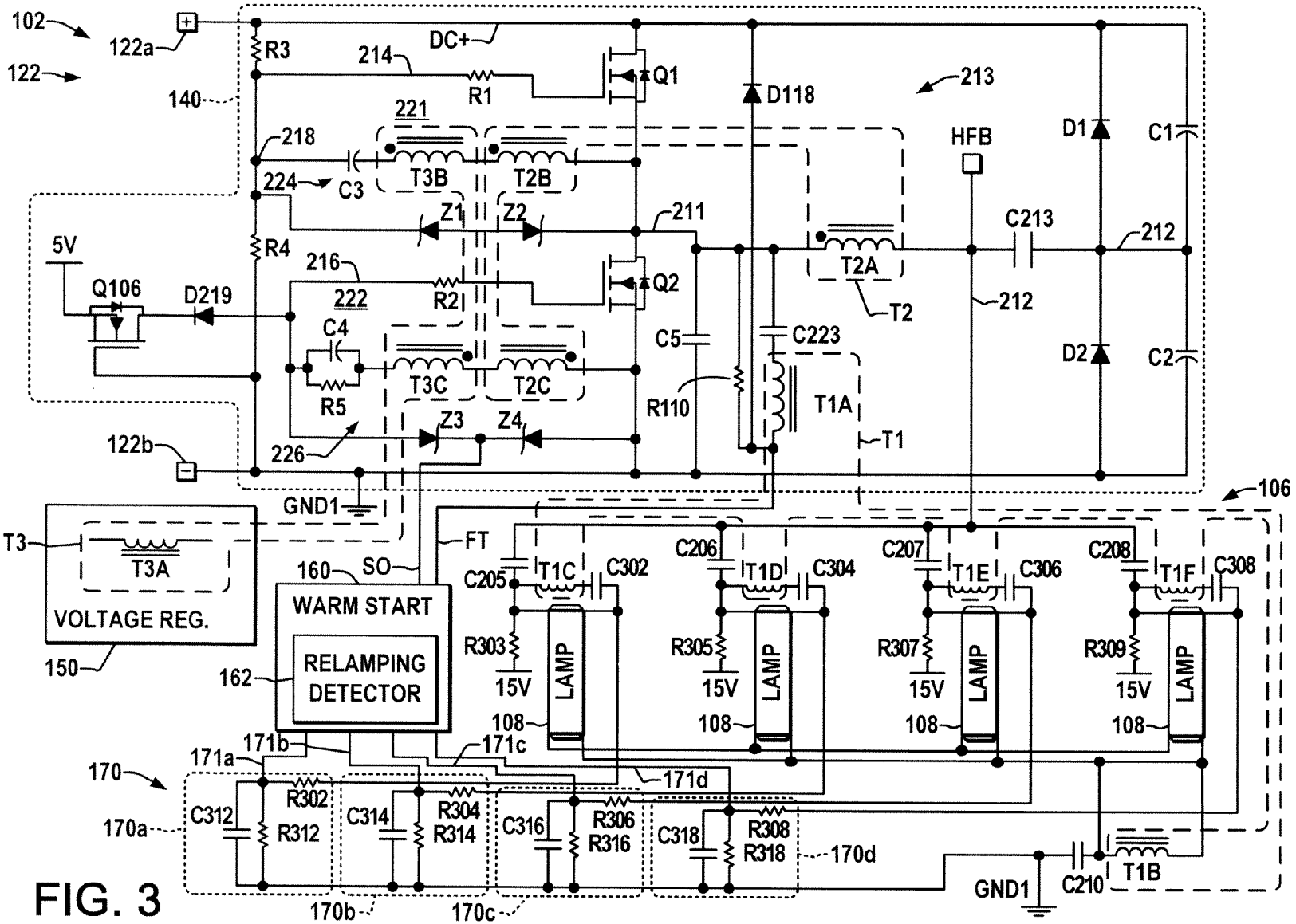
FIG. 3 is a detailed schematic diagram illustrating an exemplary self-oscillating inverter driving four parallel-connected fluorescent lamps with a relamping sensing circuit in the ballast of FIGS. 1 and 2.

FIG. 3 illustrates further details of an exemplary self-oscillating inverter 140 that receives DC power from the boost converter 120 via terminals 122*a* and 122*b*. The inverter 140 includes a resonant circuit 213 and a pair of controlled switching devices Q1 and Q2, in one example, n-type MOSFETs, although any suitable switching devices may be employed. The input DC 122 received at terminals 122*a* and 122*b* is selectively switched by Q1 and Q2 coupled in series between a positive voltage node DC+ and a negative node coupled to a first circuit ground GND1, where the selective switching of Q1 and Q2 operates to generate a square wave at an inverter output node 211, which in turn excites the resonant circuit 213 to thereby drive a high frequency bus at node 212 (HFB).

The inverter 140 includes transformers T2-T3 for output power sensing and control for self-oscillation with adjustable inverter operating frequency, as well as a transformer T1 for cathode heating operation. Transformer T2 has a first winding T2A in series between the inverter output 211 and the HFB 212 along with windings T2B and T2C in switch drive control circuits 221 and 222 associated with the switching devices Q1 and Q2, respectively. In operation of the inverter 140, the winding T2A acts as a primary in the resonant circuit 213 and the secondary windings T2B and T2C are connected in the gate drive circuits for Q1 and Q2, respectively for oscillatory actuation of the switches according to the resonance of the circuit 213. Transformer T3 has a first winding T3A operative as a frequency control inductance in the regulator 150 and windings T3B and T3C in the switch control circuits 221 and 222, where each drive control circuit 221, 222 includes a series combination of windings from T2 and T3. The third transformer T3 is used by the voltage regulator 150 to selectively control the inductance of the gate drive circuits 221 and 222 and thus to control the inverter operating frequency for closed loop operation of the inverter 140 to control the amount of power delivered to the lamps 108 at the output 106.

AC power from the high frequency bus 212 provides an AC output 106 used to drive one or more lamp loads 108 (four lamps 108 shown in the illustrated example of FIG. 3) via corresponding ballasting capacitors C205-C208, where any number of lamps 108 can be thus coupled with the high frequency bus 212.

A transformer T1 is provided to implement selective heating for lamp cathodes, including a primary winding T1A coupled to the inverter output 211 via a capacitor C223 and coupled via a node FT to a program-start circuit 180 (FIG. 4 below) for selective actuation. Node FT is also coupled to the DC+ voltage via diode D118. The transformer T1 includes secondary windings T1C, T1D, T1E, and T1F for heating individual upper lamp cathodes as well as a common secondary T1B to which all the lower cathodes are coupled for heating. The lower common lamp terminals are coupled to GND1 through blocking capacitor 210, which provides striation control, and to the winding T1B.

The high frequency bus is generated at the node 212 by the inverter 140 and the resonant circuit 213, which includes a resonant inductance T2A as well as an equivalent resonant capacitance including the equivalent of capacitors C1 and C2 connected in series between the DC+ and GND1 nodes, with a center node coupled to the bus 212 via capacitor 213. A clamping circuit is formed by diodes D1 and D2 individually coupled in parallel with the capacitances C1 and C2, respectively. The switches Q1 and Q2 are alternately activated to provide a square wave of amplitude DC+/2 at the common inverter output node 211 (e.g., half the DC bus voltage across the terminals 122*a* and 122*b*), and this square wave inverter output excites the resonant circuit 213. Gate or control lines 214 and 216 include resistances R1 and R2 to provide control signals to the control terminals of Q1 and Q2, respectively.

The switch gating signals are generated using the drive circuits 221 and 222, with the first drive circuit 221 coupled between the inverter output node 211 and a first circuit node 218, and the second drive circuit 222 coupled between the circuit ground GND1 and node 216. The drive circuits 221 and 222 include the first and second driving inductors T2B and T2C of transformer T2, which are secondary windings mutually coupled to the resonant inductor T2A of the resonant circuit 213 to induce voltage in the driving inductors T2B and T2C proportional to the instantaneous rate of change of current in the resonant circuit 213 for self-oscillatory operation of the inverter 140. In addition, the drive circuits 221 and 222 include the secondary inductors T3B and T3C serially connected to the respective first and second driving inductors T2B and T2C and the gate control lines 214 and 216. The windings T3B and T3C operate as drive control inductances voltage regulator 150 having a tertiary frequency control inductance winding T3A by which the voltage regulator 150 (FIG. 4) can change the oscillatory frequency of the inverter 140 by varying the inductance of the windings T3B and T3C through control of the current through the frequency control inductance T3A.

In operation, the gate drive circuits 221 and 222 maintain Q1 in an "ON" state for a first half of a cycle and the switch Q2 "ON" for a second half of the cycle to generate a generally square wave at the output node 211 for excitation of the resonant circuit 213. The gate to source voltages Vgs of the switching devices Q1 and Q2 in one embodiment are limited by bi-directional voltage clamps Z1, Z2 and Z3, Z4 (e.g., back-to-back Zener diodes) coupled between the respective switch sources and the gate control lines 214 and 216. In this embodiment, the individual bi-directional voltage clamp Z1, Z2 and Z3, Z4 cooperate with the respective inductor T3B and T3C to control the phase angle between the fundamental frequency component of voltage across the resonant circuit 213 and the AC current in the resonant inductor T2A. In some embodiments, the node SO between the Zener diodes Z3 and Z4 is connected to the warm start circuit 160 for selective switching to ground, which is illustrated in greater detail in FIG. 4.

To start the inverter 140, series coupled resistors R3 and R4 across the input terminals 122*a* and 122*b* cooperate with a resistor R110 (coupled between the inverter output node 211 and the circuit GND1) to initiate regenerative operation of the gate drive circuits 221 and 222. The inverter switch control circuitry further includes capacitors C3 and C4 coupled in series with the windings T3B and T3C, respectively. When DC power is initially provided to the inverter 140, C3 is charged from the positive DC input 122*a* via R3, R4 and R110, while a resistor R5 shunts the capacitor C4 in the drive circuit 222 to prevent C4 from charging and thereby prevents concurrent activation of Q1 and Q2. Since the voltage across C3 is initially zero, the series combination of T2B and T3B acts as a short circuit due to a relatively long time constant for charging of the capacitor C3. Once C3 charges up to the threshold voltage of the Vgs of Q1, (e.g., 2-3 volts in one embodiment), Q1 turns ON and a small bias current flows through Q1. This current biases Q1 in a common drain, Class A amplifier configuration having sufficient gain to allow the combination of the resonant circuit 213 and the gate control circuit 221 to produce a regenerative action to begin oscillation of the inverter 140 at or near the resonant frequency of the network including C3, T3B, and T2B, which is above the natural resonant frequency of the resonant circuit 213. As a result, the resonant voltage seen at the high frequency bus node 212 lags the fundamental of the inverter output voltage at node 211, thereby facilitating soft-switching operation of the inverter 140. The inverter 140 therefore begins operation in a linear mode at startup and transitions into switching Class D mode. The inverter will not start up until the 5V power supply reaches at least the threshold of the depletion mode MOSFET Q106. When this happens, the voltage at the gate of Q2 rises and allows the inverter 140 to begin oscillating.

In steady state operation of the ballast 102, the square wave voltage at the inverter output node 211 has an amplitude of approximately one-half of the voltage of the positive terminal 122*a* (e.g., DC+/2), and the initial bias voltage across C3 drops. In the illustrated inverter 140, a first network 224 including the capacitor C3 and inductor T3B and a second network 226 including the capacitor C4 and inductor T3C are equivalently inductive with an operating frequency above the resonant frequency of the first and second networks 224, 226. In steady state oscillatory operation, this results in a phase shift of the gate circuit to allow the current flowing through the inductor T2A to lag the fundamental frequency of the voltage produced at the inverter output node 211, thus facilitating steady-state soft-switching of the inverter 140. The output voltage of the inverter 140 in one embodiment is clamped by the serially connected clamping diodes D1 and D2 to limit high voltage seen by the resonant circuit capacitors C1 and C2. As the inverter output voltage at node 211 increases, the clamping diodes D1, D2 start to clamp, preventing the voltage across the capacitors C1 and C2 from changing sign and limiting the output voltage to a value that prevents thermal damage to components of the inverter 140.

In the illustrated inverter 140, as the operating frequency decreases, the output current increases, and vice versa. The inverter frequency, moreover, decreases with decreased loading of the frequency control inductance T3A. Thus, the voltage regulator 150 (FIG. 4 below) increases or decreases the loading on T3A to reduce or raise the lamp power, respectively. The inverter 140 thus produces an output 106 at the HFB 212 to power a plurality of parallel lamps 108, and the regulator 150 limits the inverter output voltage 106 so that conduction of a rectifying lamp 108*r* cannot be sustained by the corresponding ballasting capacitor, while conduction of non-rectifying lamps 108*n* is maintained.

When the emission mix at a given filament of a lamp 108 starts to become depleted, the lamp 108 begins to rectify the applied AC voltage (e.g., rectifying lamps referred to herein as 108*r* having voltage behavior shown in FIG. 5 below), and additional energy is required to pass the electrons from the depleted filament to the good filament in the lamp 108*r*. The resulting DC voltage across the rectifying lamp 108*r* charges the corresponding series-connected ballasting capacitance C205-C208. The voltage across the rectifying lamp 108*r* is thereby offset and the charged ballasting capacitor quenches the lamp current to the point where the rectifying (EOL) lamp 108*r* goes to a glow state. In one example, the regulator 150 regulates the HFB to about 225 volts for a lamp 108 rated for about 140 volts, with the ballasting capacitor 106*c* (e.g., the corresponding one of C205-C208) having a capacitance value of 4700 pF. In this case, the regulation of the HFB 212 to the relatively low value allows continued regulated operation of the inverter 140 to adequately power the non-rectifying (e.g., non-EOL) lamps 108*n* for normal light output while the ballasting capacitance 106*c* of the rectifying lamp 108*r* gets charged enough to quench the rectifying lamp's current, thereby forcing the rectifying (e.g., EOL) lamp 108*r* into the glow state.

It is noted that conventional non-dimming program-start ballasts instead provide no inverter voltage regulation or regulate the high frequency bus to a high level (e.g., 400 volts), and thus do not allow the selective current quenching of EOL lamps, and must instead provide expensive EOL detection circuitry and shut off the inverter when an EOL condition is sensed. The presently disclosed embodiments, on the other hand, allow the inverter 140 to continue normal regulated operation to maintain conduction of non-rectifying lamps 108*n* while the rectifying lamp or lamps 108*r* are safely brought to the glow state. Thus, careful tailoring of the regulated normal operating voltage of the inverter 140 by the voltage regulator 150, together with sizing of the ballasting capacitors 106*c* can be successfully employed for any size lamp 108.

With continued reference to FIG. 3, the relamping sense circuit 170 includes a sense circuit 170*a*-170*d* for each lamp 108 in the ballast 102. The sense circuit 170*a* includes series resistors R302 and R312 coupling the upper filament (cathode) of the lamp 108 to GND1. The connection of the two resistors R302 and R312 is at node 171*a*, and the circuit 170*a* includes a sense capacitor C312 coupled from node 171*a* to GND1. The illustrated embodiment of FIG. 3 includes relamping sense circuits 170*b*-170*d* individually associated with the other three lamps 108 having corresponding voltage divider resistors R304, R306, R308, R314, R316, and R318 as well as sense capacitances C314, C316, and C318. The other relamping sense circuits 170*b*-170*d* operate in similar fashion to the circuit 170*a* to sense the presence or absence of a lamp 108 in the ballast 102 and to generate a relamping detection signal 171 indicating the presence or absence of the lamp 108.

In the ballast circuit for the exemplary first lamp 108 in FIG. 3, 15 VDC is supplied through a resistor R303, the upper filament of the lamp 108, and the resistor R302 of the corresponding relamping sense circuit 170*a*. The ballasting capacitor C205 for the first lamp 108 prevents the DC signal from propagating to the inverter 140 while the capacitor C302 in series with inductor winding T1C forces the signal to go through the cathode of the lamp 108 to resistor R302. When a lamp 108 is present, the DC signal propagates through the cathode of the lamp 108 reaching the relamping sense circuit node 171*a* to indicate the presence of the lamp 108. Conversely, when no lamp is present in the ballast 102, the signal stops at the open circuit and the voltage at the sense circuit node 171*a* indicates the absence of the lamp 108. Signals 171*a*-171*d* are fed to the warm-start circuit 160 (FIG. 4), which responds to the signals as detailed below. The circuits 170 sense the presence (or absence) of a lamp filament, and when a defective lamp 108*r* is removed from its sockets (e.g., when the user notices a glowing lamp 108*r* in the ballast 102), the DC voltage of C312, for example, goes to zero because the DC source connection is broken by the removed filament. In such a case, the sense circuit 170*a* generates a relamping detection signal 171*a* (having a low level in this example, as shown in FIG. 5) indicating the absence of a lamp 108, and the circuit 170 provides corresponding relamping detection signals 171*a*-171*d* to the relamping detector 162 of the warm start circuit 160.

In one embodiment, a processor U300 of the relamping detector 162 (FIG. 4) is programmed to note the low level, but maintains normal operation in the ballast 102 by continuing the normal operational mode of the voltage regulator 150. As a result, all of the remaining good lamps 108*n* stay lit because the high frequency bus HFB is being regulated. When a new lamp 108*a* is installed, the DC connection of the sensing circuit 171*a* is restored, and the detection signal 171*a* again goes high. The processor notes this change in the voltage of C312 (high-going transition in signal 171*a*) and turns on Q320 of the regulator 150 (FIG. 4). When Q320 turns on, it removes the HFB bus feedback signal and causes the HFB to increase to the ignition voltage level, thereby restarting the newly inserted lamp 108*a* while the other lamps 108*n* remain lit. When the new lamp 108*a* starts, an observer will see a momentary slight increase in the light level of the lamps 108*n* that have been operating, but the light level returns to normal after a short time, such as around 100 ms in one example. Thus none of the lamps 108 go out that have been emitting light and the new lamp 108*a* is restarted.

Referring now to FIG. 4, the exemplary voltage regulator 150 operates in a normal operating state to selectively vary the loading of T3A to control the inverter operating frequency so as to regulate the AC bus voltage at node 212 to a value such that the voltage across non-rectifying lamps 108*n* is at or above the normal lamp operating voltage (e.g., about 125 volts AC in one example). The regulation point of the regulator 150 is set to control the inverter output voltage 106 at generally constant regulated output value such that rectification of one or more lamps 108*r* causes the corresponding ballasting capacitor 106*c* to charge up without maintaining sufficient current to keep the lamp 108*r* lit and the rectifying lamp 108*r* goes into a glow state. The regulated output value is also sufficient to ensure that non-rectifying lamps 108*n* operate at their rated current.

In an igniting mode, the regulator 150 is brought to a non-regulating state by actuation of the transistor Q320 so that the voltage across the non-rectifying lamps 108*n* is at or above a lamp igniting voltage. For closed-loop regulation mode, the voltage regulator 150 senses the HFB voltage via resistor R212 capacitively coupled to the bus node 212 by capacitor C216 to control a gate of an n-channel enhancement mode control MOSFET Q203. In this regulation mode, the MOSFET Q203 controls the loading of the tertiary winding T3A to set the frequency of the inverter 140, in effect, increasing or decreasing the loading on T3A to reduce or raise the HFB voltage. The gate signal to Q203 is delayed on startup by a time constant set by R206, R207, and C203 so that voltage regulator 150 does not begin to control the inverter 140 until initial preheating is completed. Zener Z209 and a capacitor C225 clamp the voltage at the drain of Q203 relative to GND1 and another Zener Z208 clamps the MOSFET source. The regulator 150 includes resistor R213 and capacitor C219 connected in series between the gate and source of Q203. The frequency control inductance T3A is connected to a four-diode rectifier and also to control terminals B and C to allow the warm-start circuit 160 to selectively bypass the regulation (increase the inverter output voltage) as described below.

The resistors R213 and R207 establish a bias point for operation of the voltage regulator 150 such that higher bus voltages cause Q203 to increase the loading on T3A thereby increasing the inverter frequency to lower the output power, whereby the high frequency bus voltage at node 212 will not exceed a predetermined threshold set by the bias point.

With continued reference to FIG. 4, the program-start circuit 180 operates to heat the lamp cathodes upon start-up of the ballast 102 under control of a microprocessor U300 of the warm start circuit 160. A heating transistor Q330 has a collector coupled to the cathode heat transformer primary winding T1A at node FT (FIG. 3). At start up, Q330 is turned on, thereby energizing the cathode heat control primary winding T1A. This causes heating currents to flow in the secondary windings T1B-T1F (FIG. 3) to heat the filaments (cathodes) of the lamps 108.

The heating mode in the illustrated embodiment continues for a pre-determined time period set by the microprocessor U300. The output of the microprocessor U300 is coupled to the gate of a MOSFET Q324 to turn off Q330 to end the heating activation of T1 after this preset time period has expired. The microprocessor U300 also activates MOSFET pair Q326 and Q329 for selectively shorting the frequency control inductance T3A during the heating period via terminals CT3 and CT4. In this manner, the program-start circuit 180 also values the loading of T3A to reduce the frequency of the inverter output to a predetermined low value.

FIG. 4 also illustrates an exemplary warm-start circuit 160 including the microprocessor U300, which is operatively coupled with the quenching system 170 to receive lamp presence signals 171. When the microprocessor U300 detects relamping of one or more of the lamp circuits of the ballast 102 (e.g., a low-high transition of the signal 171 indicating the absence of a lamp 108 followed by the presence of that lamp 108), it will activate the gate of a MOSFET Q320 in the regulator 150, which shorts the bias point (junction of R213 and R207) of control MOSFET Q203 to GND1. When the bias point is shorted to GND1, the HFB is essentially removed from the feedback loop, so the voltage regulator 150 is at the same voltage as when the ballast 102 first starts-up. As described above, the gate signal to Q203 is delayed on startup by a time constant set by R206, R207, and C203. During this time, the voltage supplied by the inverter 140 is at or above a lamp igniting voltage level and the newly added lamp 108*a* ignites.

The ballast 102 does not require a user to cycle power to ignite the newly added lamp 108*a* after a relamping. Moreover, as described above, the exemplary ballast 102 does not shut down the inverter 140 when a lamp 108*r* suffers from emission mix depletion, but instead drops the rectifying lamp's voltage to a safe glow state which keeping non-rectifying lamps 108*n* lit, thereby facilitating easy identification of EOL lamps without leaving the user in the dark.

FIG. 5 illustrates the voltage amplitude for lamps 108 and the relamping detection signals 171 generated by the exemplary first relamping sense circuit 170*a* in operation with the corresponding lamp 108*r* entering an EOL condition. The top graph illustrates the voltage amplitude of a rectifying lamp 108*r* from start-up (t0) to re-ignition after being replaced. The middle graph illustrates the voltage amplitude of a non-rectifying lamp 108*n* from start-up (t0) to re-ignition after a different lamp 108*r* is replaced. The bottom graph illustrates the relamping detection signal voltage 171 from the circuit 170 associated with a rectifying lamp 108*r*.

From t0-t1, the program-start circuit 180 heats the cathodes of the lamps 108. At t1, the predetermined pre-heat period is over and C203 charges while the inverter 140 supplies a lamp igniting voltage 362 to ignite the lamps 108. The period between t1 and t2 represents the time constant set by R206, R207, and C203. At t2, the voltage regulator 150 regulates the inverter output voltage 106 such that the voltage across non-rectifying lamps 108*n* is at or above a normal lamp operating voltage 364 and these lamps are provided with their normal operating current via the corresponding ballasting capacitors 106*c*. The time intervals up to this point are all predetermined by either the time constant or the microprocessor U300 in the illustrated embodiments.

After an undetermined amount of time, shown as t3 in FIG. 5, one of the cathodes of one of the lamps 108 may get depleted and the lamp 108*r* will rectify. At t3, the corresponding ballasting capacitor (e.g., C205 in one example) charges which reduces (offsets) the voltage across the rectifying lamp 108*r* by an amount 368 and the capacitor C205 can no longer provide the rated operating current to the rectifying lamp 108*r*. Consequently, the voltage across the rectifying lamp 108*r* is at a glow voltage 366 and the lamp 108*r* is maintained at most in a glow state that prevents the filaments from overheating. Also at t3 and thereafter, the voltage across the non-rectifying lamps 108*n* is maintained at the normal lamp operating voltage 364.

At t4, the rectifying lamp 108*r* has been removed from the ballast 102 by a user, thereby causing the relamping sense circuit capacitor C312 to discharge. Removal of a lamp 108 in the ballast 102 does not extinguish lamps 108*n* remaining in the ballast 102, which therefore provides true parallel operation. At t5, a new lamp 108*a* is added to the ballast 102 while the ballast remains powered (the user need not cycle power to replace an EOL lamp 108). The microprocessor U300 senses that a new lamp 108*a* has been added to the ballast 102 and grounds the bias point in the voltage regulator 150 by actuating Q320. The time between t5 and t6 in FIG. 5 is the predetermined time that the microprocessor U300 grounds the bias point plus the time of the time constant set by R206, R207, and C203. At t5, the voltage across the lamps 108 is set to the lamp igniting voltage 362 and the newly added lamp 108*a* ignites without the need to cycle power to the ballast 102. Finally at t6, the voltage regulator 150 regulates the inverter output voltage 106 to provide the normal lamp operating voltage 364 to the lamps 108.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. A ballast for operating at least one fluorescent lamp, the ballast comprising:

a DC power circuit operative to receive an AC input and to produce a DC output;

an inverter operatively coupled to the DC power circuit to convert the DC output to produce an inverter output voltage to power at least one lamp;

at least one ballasting capacitor coupled in series between the inverter and the at least one lamp; and a voltage regulator operative in a normal operation state to control the inverter output voltage at generally constant regulated output value such that a non-rectifying lamp operates at its rated current and such that rectification of a lamp causes the corresponding ballasting capacitor to charge up without maintaining sufficient current to keep the lamp lit and the rectifying lamp goes into a glow state.

2. The ballast of claim 1, where the inverter produces the inverter output voltage to power a plurality of parallel lamps, the ballast comprising a plurality of ballasting capacitors individually coupled in series between the inverter and a corresponding one of the plurality of lamps.

3. The ballast of claim 2, where the voltage regulator is operative in an igniting state to control the inverter output voltage such that the voltage across any non-rectifying lamps is at or above a lamp igniting voltage, the ballast further comprising:

a warm-start circuit operative to detect whether a lamp has been added to the ballast while the ballast is operational, to switch the voltage regulator into the igniting state to ignite the newly added lamp, and to return the voltage regulator to the normal operation state after a predetermined period of time.

4. The ballast of claim 3, further comprising a relamping sense circuit coupled with at least one of the lamps, and operative to generate a relamping detection signal indicating the presence or absence of the at least one lamp in the ballast, wherein the warm-start circuit comprises a relamping detection circuit operative to receive the relamping detection signal and to detect a change in the relamping detection signal indicating that a lamp has been added to the ballast, to switch the voltage regulator into the igniting state to ignite the newly added lamp upon or after detecting the change, and to return the voltage regulator to the normal operation state a predetermined period of time after switching the voltage regulator to the igniting state.

5. The ballast of claim 2, further comprising a program-start circuit operative at start-up to pre-heat cathodes of the lamps and then apply the inverter output voltage to ignite the plurality of parallel lamps.

6. The ballast of claim 5, further comprising a warm-start circuit operative to detect whether a lamp has been added to the ballast while the ballast is operational, to switch the voltage regulator into the igniting state to ignite the newly added lamp, and to return the voltage regulator to the normal operation state after a predetermined period of time.

7. The ballast of claim 2, wherein the generally constant regulated output value of the inverter output voltage is 225V.

8. A non-dimmable, program-start ballast for operating at least one fluorescent lamp, the ballast comprising:

a DC power circuit to receive an AC input and to produce a DC output;

an inverter operatively coupled to the DC power circuit to convert the DC output to produce an inverter output voltage to power at least one lamp, the inverter being regulated to limit the inverter output voltage so that conduction of a rectifying lamp cannot be maintained while conduction of a non-rectifying lamp is maintained; and a program-start circuit which pre-heats at least one lamp cathode before supplying the inverter output voltage to the at least one lamp.

9. The non-dimmable, program-start ballast of claim 8, where the inverter produces the inverter output voltage to power a plurality of parallel lamps, and where the program-start circuit is operative to pre-heat cathodes of the plurality of parallel lamps before supplying the inverter output voltage to the plurality of parallel lamps.

10. The non-dimmable, program-start ballast of claim 9, further comprising a warm-start circuit operative to detect whether a lamp has been added to the ballast while the ballast is operational, to switch inverter into an igniting state to ignite the newly added lamp, and to return the inverter output voltage to the normal operation state after a predetermined period of time.

* * * * *